US007118003B2

(12) United States Patent
Sellari et al.

(10) Patent No.: US 7,118,003 B2
(45) Date of Patent: Oct. 10, 2006

(54) TAMPER RESISTANT CONTAINER WITH TAMPER-EVIDENT FEATURE AND METHOD OF FORMING THE SAME

(75) Inventors: Robert Sellari, Shelton, CT (US); Peter Boback, Stratford, CT (US); Bruce Stein, Easton, CT (US)

(73) Assignee: Inline Plastics Corp., Shelton, CT (US)

( * ) Notice: Subject to any disclaimer, the term of this patent is extended or adjusted under 35 U.S.C. 154(b) by 0 days.

(21) Appl. No.: 10/895,687

(22) Filed: Jul. 21, 2004

(65) Prior Publication Data

US 2005/0017007 A1 Jan. 27, 2005

Related U.S. Application Data

(60) Provisional application No. 60/489,093, filed on Jul. 21, 2003.

(51) Int. Cl.
*B65D 41/32* (2006.01)

(52) U.S. Cl. ..... 220/266; 220/4.21; 220/780

(58) Field of Classification Search ..... 220/266, 220/270, 4.23, 4.25, 4.21, 835, 784, 780–783; 215/901

See application file for complete search history.

(56) References Cited

U.S. PATENT DOCUMENTS

| | | | | | |
|---|---|---|---|---|---|
| 4,433,793 | A * | 2/1984 | Ingemann | ..... | 220/276 |
| 4,535,889 | A * | 8/1985 | Terauds | ..... | 206/527 |
| 5,040,695 | A * | 8/1991 | Adams et al. | ..... | 220/270 |
| 5,219,087 | A * | 6/1993 | Christensson | ..... | 220/270 |
| 5,507,406 | A * | 4/1996 | Urciuoli et al. | ..... | 220/269 |
| 5,573,134 | A * | 11/1996 | Chenault et al. | ..... | 220/276 |
| 5,897,011 | A * | 4/1999 | Brilliant et al. | ..... | 220/4.23 |
| 5,931,332 | A * | 8/1999 | Mygatt et al. | ..... | 220/270 |
| 2003/0052133 | A1 | 3/2003 | Hayes et al. | | |

FOREIGN PATENT DOCUMENTS

| | | | | |
|---|---|---|---|---|
| DE | 78 16 353 U1 | 11/1978 | | |
| DE | 4418935 | * 12/1995 | ..... | 220/270 |
| DE | 1999-083197 | * 8/1999 | ..... | 220/270 |
| EP | 0 752 374 A1 | 1/1997 | | |
| GB | 2257118 A | 1/1993 | | |

* cited by examiner

*Primary Examiner*—Lien M. Ngo
(74) *Attorney, Agent, or Firm*—Edwards Angell Palmer & Dodge LLP

(57) ABSTRACT

A tamper-resistant container with tamper evident feature which includes a cover portion defining a outwardly extending peripheral flange, a base portion defining an upper peripheral edge, and a hinge joining the outwardly extending peripheral flange with the base portion. The upper peripheral edge includes an upwardly projecting bead extending substantially about the perimeter of the base portion that is configured to render the outwardly extending flange of the cover portion relatively inaccessible when the container is closed. The hinge includes a frangible section, which upon severing, provides a projection that extends out beyond the upwardly projecting bead of the upper peripheral edge of the base portion, for facilitating removal of the cover portion from the base portion to open the container.

26 Claims, 8 Drawing Sheets

FIG. 3
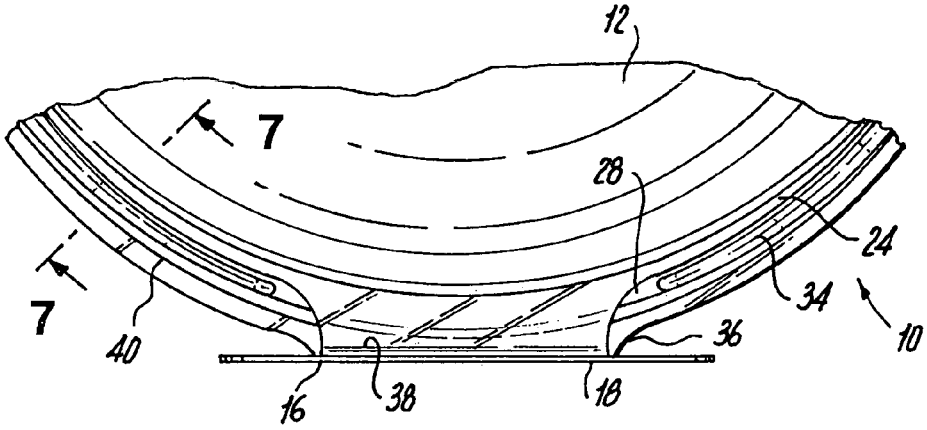
FIG. 4
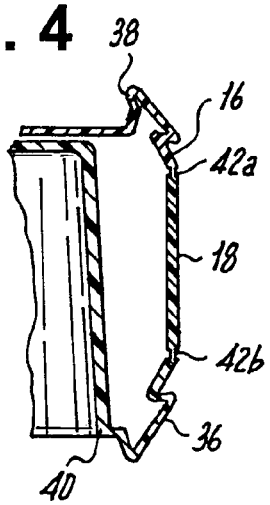
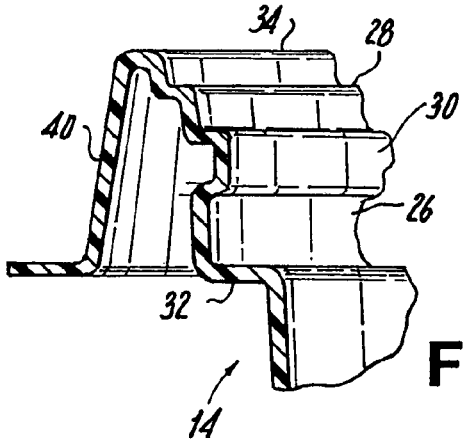
FIG. 5
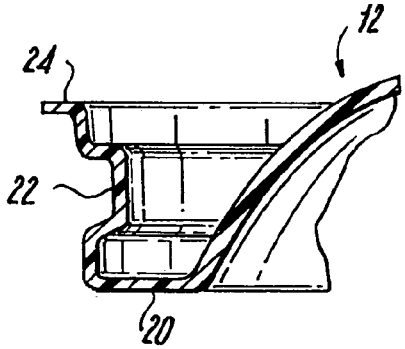
FIG. 6
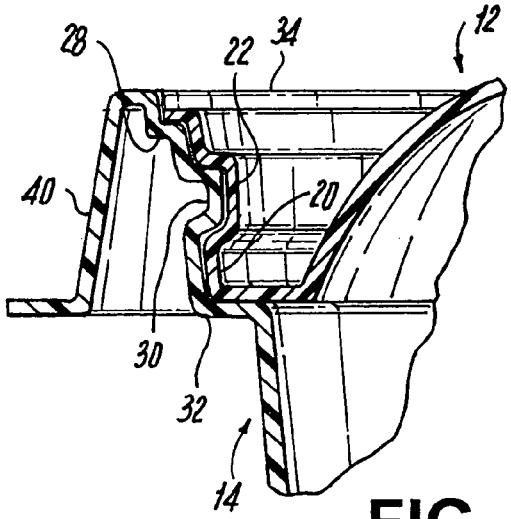
FIG. 7

FIG. 10
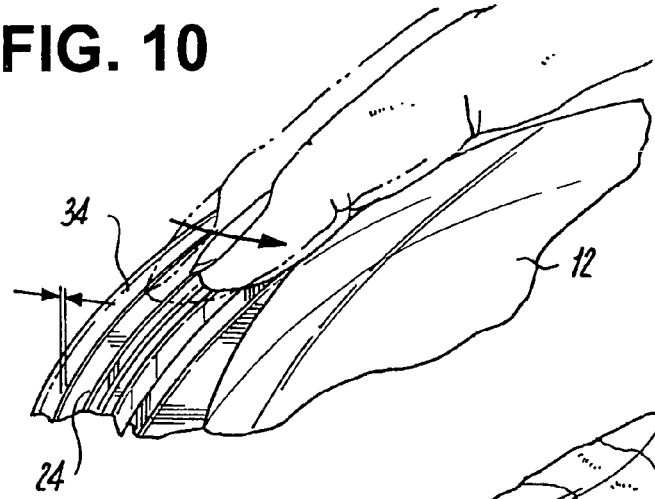
FIG. 11
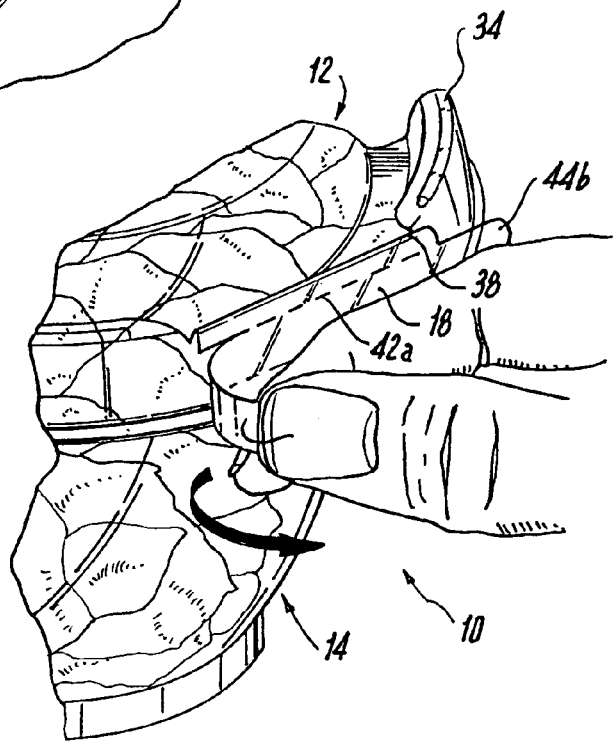
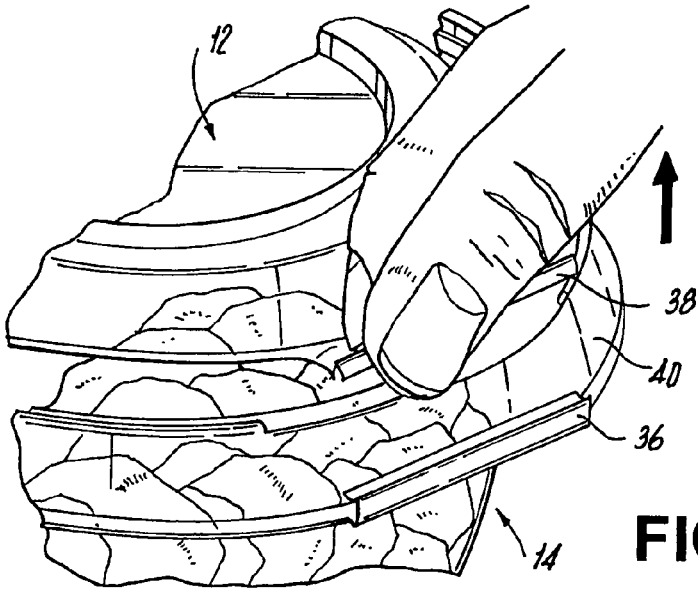
FIG. 12

FIG. 16
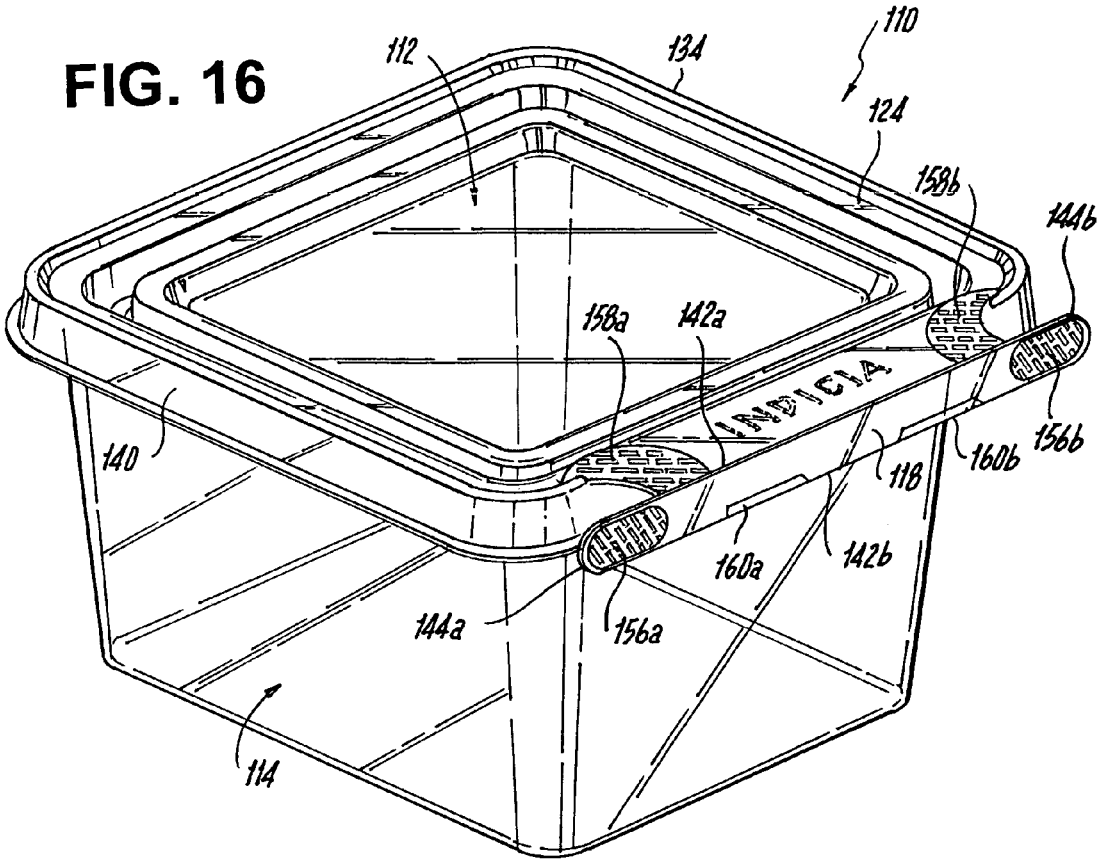
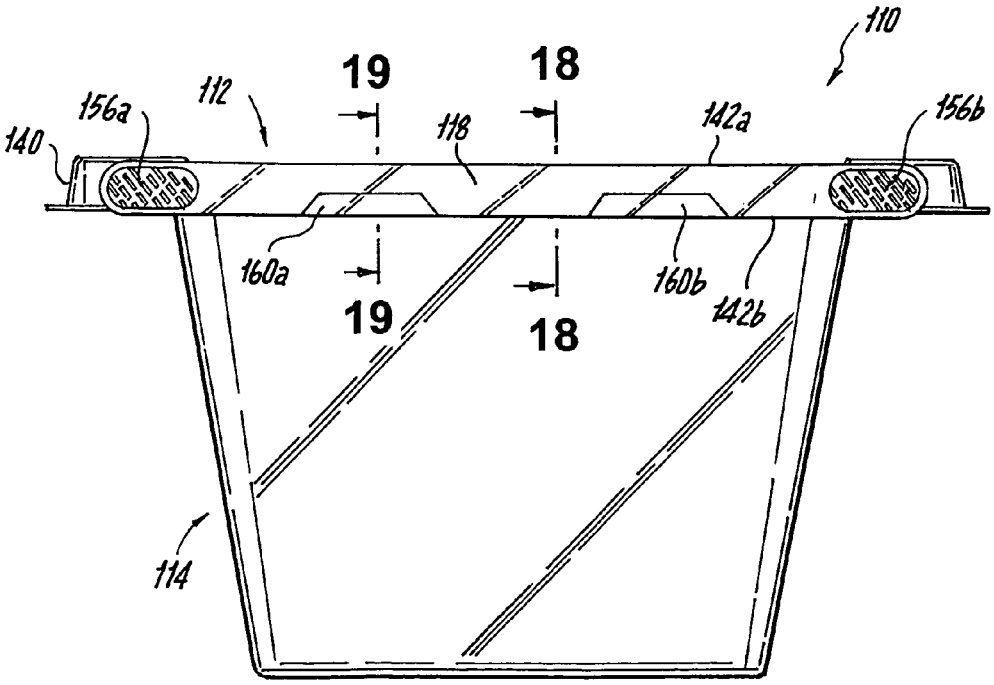
FIG. 17

TAMPER RESISTANT CONTAINER WITH TAMPER-EVIDENT FEATURE AND METHOD OF FORMING THE SAME

CROSS-REFERENCE TO RELATED APPLICATION(S)

The subject application claims the benefit of priority to U.S. Provisional Patent Application No. 60/489,093 filed Jul. 21, 2003, the disclosure of which is herein incorporated by reference in its entirety.

BACKGROUND OF THE INVENTION

1. Field of the Invention

The subject invention is directed to containers and packaging, and more particularly, to containers and packaging that incorporate tamper-resistant and tamper-evident features.

2. Background of the Related Art

Disposable containers for packaging, distributing, displaying or otherwise housing consumer items, especially perishable foods, are becoming increasingly important. Historically, perishable products had to be brought to market and sold quickly before exposure to the atmosphere caused the products to lose their freshness.

The advent of plastics resulted in many products being wrapped or packaged in plastic, both in the form of flexible plastic bags and solid plastic containers. The use of plastics in the modern-day convenience food industry has significantly improved the "shelf life" of perishable products, allowing both merchants and their customers to store the products for longer periods of time, resulting in substantial savings.

It has been found that consumers like recloseable packages, particularly for comestible products, especially in circumstances where more than one serving of a comestible product is contained therein, in order to reduce drying out or other deterioration of the comestible food product. In addition, consumers prefer to visually inspect the food product within such containers prior to purchase. Thus, fabricating containers from clear see-through plastics is desirable. For example, packaging provided for bakery goods or agriculture products has often been in the form of clear, plastic clamshell packaging, because, among other things, such clear, plastic clamshell packaging, provides a homegrown, baked-on-the-premises image which grocery retailers have found to be especially appealing to consumers.

Typically, plastic containers will include a fairly rigid lid and base, although they may be subject to some amount of flexure. The lid provided must be capable of properly and effectively sealing the container, yet the container must be constructed so that the lid is relatively easy to remove, and even replace, since it is expected that the container and lid would normally be reused.

In addition to the aforementioned consumer design preferences, it is desirable to fabricate containers that include features which either deter unauthorized tampering or clearly indicate whether unauthorized tampering has occurred, or both. These tamper-resistant/evident features typically include structural elements which, when the container is tampered with or opened without authorization, enable the consumer to easily visually recognize such tampering so that the product can then be rejected. Such tamper-resistant/evident elements are important for, among other things, deterring theft and preventing the loss of product and income for the seller, as well as instilling consumer confidence in the integrity of the contents within the container and confidence in the ability of the seller and/or manufacturer to provide and maintain quality goods.

Thus, there is a compelling interest in the development of containers having consumer-preferable design elements, such as recloseability features which are reliable and easy to operate, along with tamper-resistant/evident features that deter tampering and clearly indicate whether tampering has occurred, and which are also reliable without being burdensome to the legitimate consumer. Accordingly, the present invention is directed to a container that meets these needs.

SUMMARY OF THE DISCLOSURE

The present invention meets the aforementioned needs, while also improving upon and solving problems associated with previous containers by providing, among other things, a tamper-resistant container with tamper evident features (also referred to hereinafter as a "tamper-resistant/evident" container) that includes a cover portion defining a outwardly extending peripheral flange and a base portion defining an upper peripheral edge. The upper peripheral edge of the base portion includes, at least in part, an upwardly projecting bead extending substantially about the perimeter of the base portion. This bead is configured and dimensioned to render the outwardly extending flange of the cover portion relatively inaccessible when the container is closed.

The container can further include a hinge joining the outwardly extending flange of the cover portion with the base portion. The hinge preferably includes a frangible section, which upon severing, provides a projection that extends out beyond the upwardly projecting bead of the upper peripheral edge of the base portion to facilitate removal of the cover portion from the base portion. Preferably, the frangible section of the hinge is delimited at least in part by a pair of substantially parallel score lines, and more preferably, is further delimited by a plurality of spaced apart notches, depressions or nicks associated with the score lines.

In another embodiment, the container includes a skirt which depends downwardly from the upper peripheral rim of the base portion. Preferably, the hinge extends from the lower edge of the skirt to the outwardly extending flange of the cover portion.

The present invention is also directed to a tamper-resistant/evident container that includes a cover portion defining a outwardly extending peripheral flange, a base portion defining an upper peripheral edge and a hinge joining the outwardly extending flange of the cover portion with the base portion. This hinge also defines a frangible section, which upon severing, provides a projection that extends out beyond the upwardly projecting bead of the upper peripheral edge of the base portion, for facilitating removal of the cover portion from the base portion to open the container.

In another embodiment of the aforementioned tamper-resistant/evident container, the upper peripheral edge of the base portion includes an upwardly projecting bead extending substantially about the perimeter of the base portion which is configured to render the outwardly extending flange of the cover portion relatively inaccessible when the container is closed.

The aforementioned container preferably includes a skirt which depends downwardly from the upper peripheral edge of the base portion, so that the hinge extends from a lower edge of the skirt to the outwardly extending flange of the cover portion.

The present invention is also directed to a tamper-resistant/evident container that includes a cover portion defining a outwardly extending peripheral flange, a base portion defining an upper peripheral edge forming at least in part an upwardly projecting bead extending substantially about the perimeter of the base portion and configured to render the outwardly extending flange of the cover portion relatively inaccessible when the container is closed, and a hinge joining the outwardly extending flange of the cover portion with the base portion, the hinge defining a frangible section, which upon severing, provides a projection that extends out beyond the upwardly projecting bead of the upper peripheral edge of the base portion, for facilitating removal of the cover portion from the base portion to open the container.

The aforementioned container can also include a skirt which depends downwardly from the upper peripheral edge of the base portion. Preferably, in this embodiment, the hinge extends from a lower edge of the skirt to the outwardly extending flange of the cover portion.

In another embodiment of the aforementioned container, the projection that extends out beyond the upwardly projecting bead of the upper peripheral edge of the base portion includes patterned sections to facilitate gripping thereof. It is also preferable that, upon severing the frangible section, the projection that extends out beyond the upwardly projecting bead of the upper peripheral edge of the base portion further includes tabs for facilitating removal of the cover portion from the base portion to open the container.

These and other aspects of the present invention will become more readily apparent to those having ordinary skill in the art from the following detailed description of the invention taken in conjunction with the drawings.

BRIEF DESCRIPTION OF THE FIGURES

So that those having ordinary skill in the art to which the subject invention pertains will more readily understand how to make and use the tamper-resistant/evident package disclosed herein, embodiments thereof will be described in detail below with reference to the drawings, wherein:

FIG. 3 is a partial top view of the container shown in FIG. 1, illustrating in particular the hinge having a frangible section or strip and projection associated therewith that extends beyond the upwardly projecting bead associated with the upper peripheral surface of the base portion;

FIG. 4 is a partial cross sectional view of the container shown in FIG. 1, taken along line 4—4 of FIG. 2, illustrating in particular the hinge having a frangible section and upper and lower projections or arms extending from the cover portion and base portion of the container;

FIG. 5 is a partial cross sectional view of the container shown in FIG. 1, taken along line 5—5 of FIG. 8, illustrating in particular the configuration of the base portion and the structural elements that facilitate a releasable/recloseable engagement with the cover portion;

FIG. 6 is a partial cross sectional view of the container shown in FIG. 1, taken along line 6—6 of FIG. 8, illustrating in particular the configuration of the cover portion and the structural elements that facilitate a releasable/recloseable engagement with the base portion;

FIG. 7 is a partial cross sectional view of the container shown in FIG. 1, taken along line 7—7 of FIG. 4, illustrating in particular the configuration of the base portion and cover portion when the container is closed and including the structural elements that facilitate a releasable/recloseable engagement between the base and cover portions;

FIG. 10 is a partial perspective view of the container shown in FIG. 1, illustrating in particular the manner in which the upwardly projecting bead on the base portion physically prevents access to the outer edge of the cover portion, making it difficult to separate the cover portion from the base portion;

FIG. 11 is a partial perspective view of the container shown in FIG. 1, illustrating in particular the manner in which the frangible section can be removed from the hinge;

FIG. 12 is a partial perspective view of the container shown in FIG. 1, illustrating in particular the upper and lower projections formed by removal of the frangible section and the manner in which the upper and lower projections facilitate separation of the cover portion from the base portion;

FIG. 16 is perspective view of a tamper-resistant/evident container constructed in accordance with the present invention in an exemplary rectangular configuration having a base portion and cover portion connected to each other by a hinge having a frangible section;

FIG. 17 is a side view of the container shown in FIG. 16, illustrating in particular the hinge having a frangible section or strip, patterned sections on opposing ends thereof, and tabs defined by the frangible section score line;

DETAILED DESCRIPTION OF THE PREFERRED EMBODIMENTS

Figure 1:
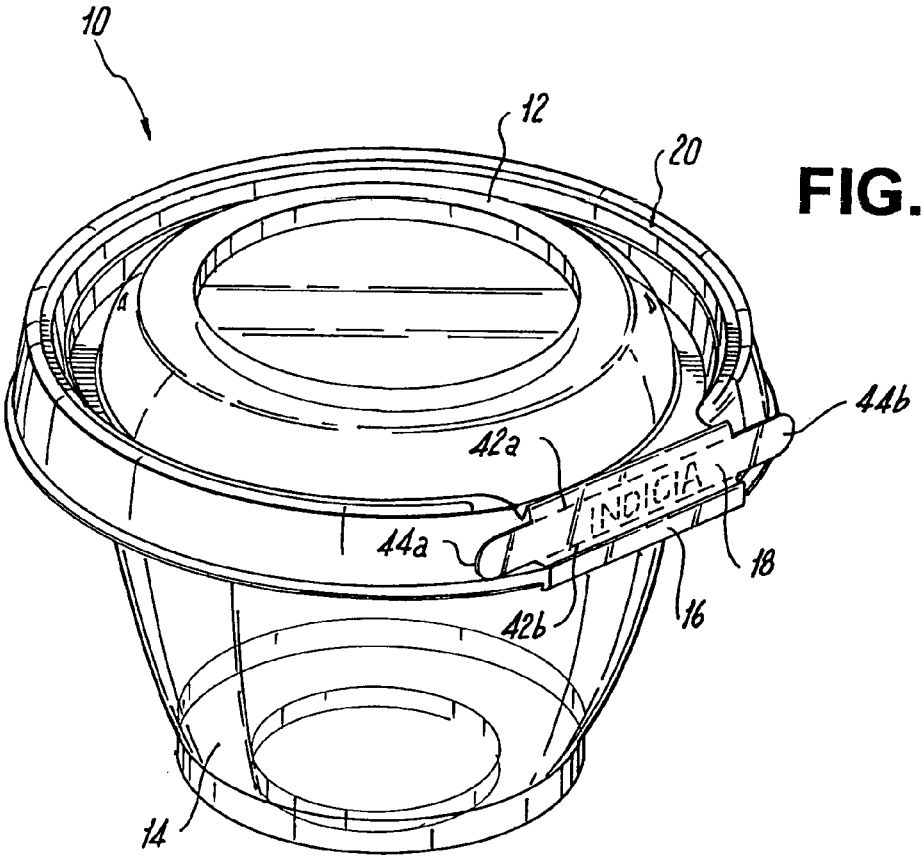
FIG. 1 is a perspective view of a tamper-resistant/evident container constructed in accordance with the present invention in an exemplary circular configuration having a base portion and cover portion connected to each other by a hinge having a frangible section.

The advantages of a tamper-evident container with tamper-resistant feature (i.e., a tamper-resistant/evident container) constructed in accordance with the present invention will become more readily apparent to those having ordinary skill in the art from the following detailed description of certain preferred and exemplary embodiments taken in conjunction with the drawings which set forth representative embodiments thereof, but are not intended to limit the scope of the present invention.

Unless otherwise apparent, or stated, directional references, such as "right," "left," "upper," "lower," "outward," "inward," etc., are intended to be relative to the orientation of a particular embodiment of the invention as shown in the first numbered view of that embodiment. In addition, a given reference numeral indicates the same or similar structure when it appears in different figures and like reference numerals identify similar structural elements and/or features of the subject invention.

Figure 2:
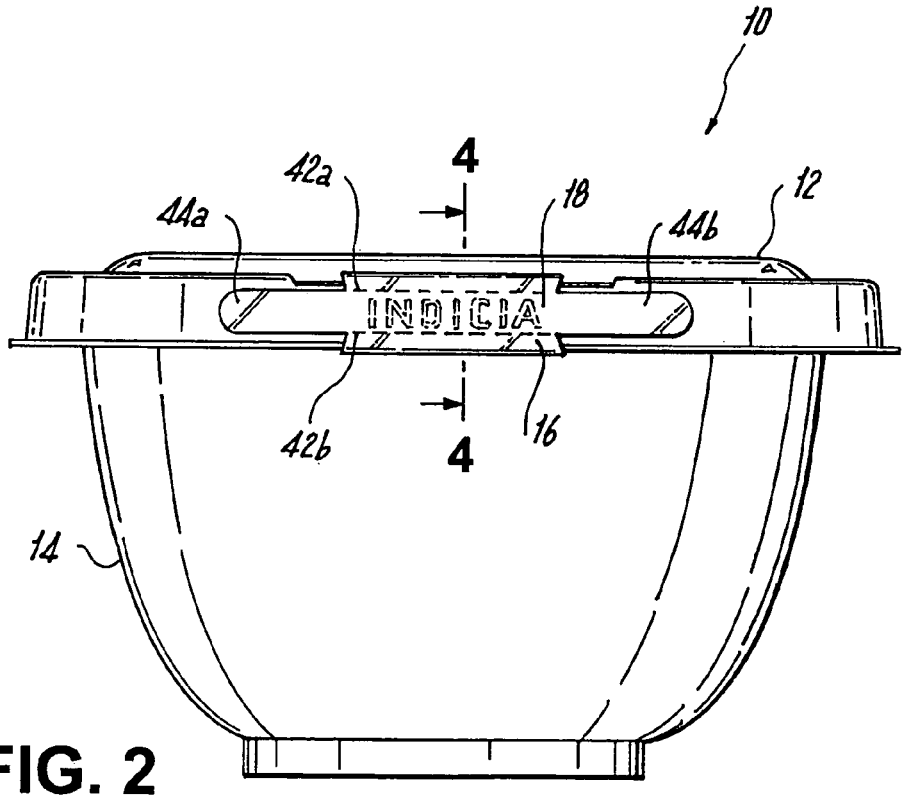
FIG. 2 is a side view of the container shown in FIG. 1, illustrating in particular the hinge having a frangible section or strip, and a suitable location for indicia to be printed thereon.
Figure 8:
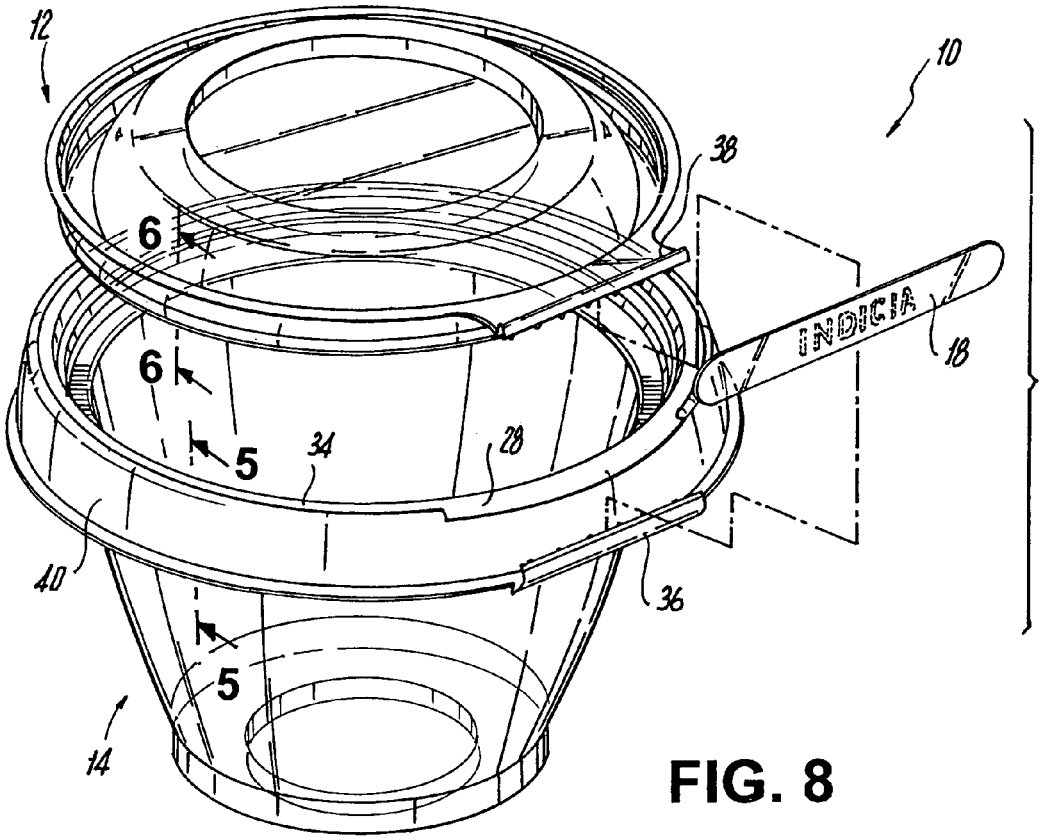
FIG. 8 is an exploded perspective view of the container shown in FIG. 1, illustrating in particular the operative association between the cover portion, base portion and frangible section.
Figure 9:
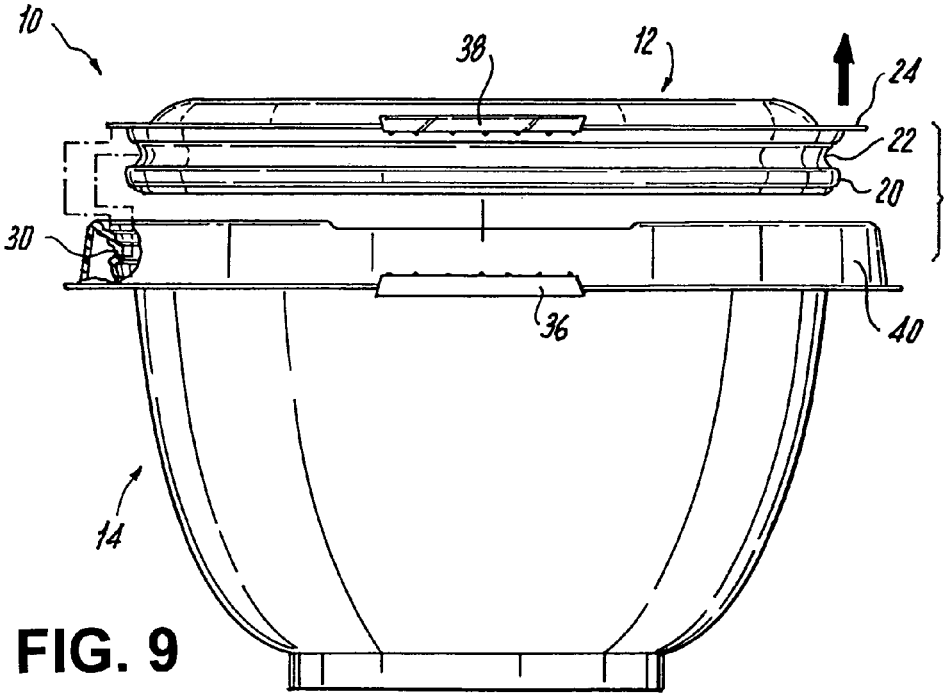
FIG. 9 is a side view of the container shown in FIG. 1, in which the frangible section has been removed, illustrating the manner in which the cover portion is separated from the base portion and the upper and lower projections or arms associated with the cover and base portions, respectively.

In accordance with an exemplary embodiment of the subject invention illustrated in FIGS. 1 and 2, the container 10 includes a generally circular cover portion 12 and a generally bowl-shaped base portion 14 joined together by a hinge 16. Hinge 16 includes a tamper-evident frangible section or pull strip 18, which, upon its removal, severs the integral connection between cover portion 12 and base portion 14.

In use, container 10 would be filled with the contents, such as foods, over the counter medicines, etc., for which consumer protection is desired and cover portion 12 would be engaged with base portion 14. In accordance with the present invention, cover portion 12 and base portion 14 include structural features that facilitate the formation of a non-permanent engagement between cover portion 12 to base portion 14.

In this embodiment, the non-permanent engagement between cover portion 12 and base portion 14 is facilitated by, among other things, a peripheral locking shoulder 20 and an radially inward circumferential groove 22 formed below an outwardly extending peripheral flange 24 on cover portion 12, which can be seated within a corresponding mating circumferential recess 26 on base portion 14. Circumferential recess 26 on base portion 14 is formed below an upper peripheral rim 28 and includes a radially inward projecting rib 30 and a radially inwardly extending rim 32.

When cover portion 12 is closed on base portion 14, projecting rib 30 mates with circumferential groove 22 on cover portion 12 and extending rim 32 mates with locking shoulder 20 on cover portion 12. In addition, outwardly extending peripheral flange 20 on cover portion 12 abuts upper peripheral rim 28 on base portion 14.

Container 10 incorporates features which are intended to prevent and deter opening container 10 without first removing frangible strip 18 from hinge 16. In this embodiment, container 10 includes an upwardly projecting bead 34 on base portion 14 that extends substantially about the perimeter of peripheral rim 22 and is positioned to surround the outer edge of flange 24 of cover portion 12 when container 10 is closed. The position and upward extension of bead 34 is configured to hinder the relatively easy method of removing a cover from conventional containers that may resemble or have characteristics in common with container 10. As can be best viewed in FIG. 10, bead 34 physically impedes access to the edge of peripheral flange 24 on cover portion 12 from fingers or any other object that might normally be used for leverage to pry cover portion 12 from base portion 14.

Hinge 16 includes an upper outwardly projecting arm 36 connected to base portion 14, and a similar lower outwardly projecting arm 38, which is connected to cover portion 12. In particular, upper arm 36 is connected with a skirt 40 that projects downward from upper peripheral rim 28 and radially outward with respect to base portion 14. Lower arm 38 is connected with the peripheral flange 24. Upper and lower arms 36 and 38 are joined together by a common attachment to frangible strip 18 to form hinge 16.

Preferably, frangible strip 18 is delimited at least in part by a pair of parallel score lines 42*a*, 42*b* or areas that have been weakened or stressed during the forming process. Frangible strip 18 may be further delimited by a plurality of spaced apart areas in which material has been removed associated with the score lines, by a plurality of spaced apart depressions associated with the score lines, or by perforation lines. The width and depth of the areas and/or depressions can vary to control the tear resistance offered by frangible strip 18. Alternatively, the integral hinge 16 could be formed with a single score line or perforation line, rather than a pair of score lines. In this instance, the single score line could be severed to create a pair of projections which would be used to open the container.

In this embodiment, strip 18 includes laterally opposed grasping tabs 44*a* and 44*b* to provide a convenient location for gripping strip 18. Preferably, instructional indicia is imprinted on strip 18 to facilitate its removal from hinge 16 and/or consumer understanding of the significance of its removal as it relates to product tampering. Strip 18 and/or the instructional indicia preferably thereon can be colored or embossed, or otherwise fabricated to direct attention thereto.

As can be best viewed in FIGS. 11 and 12, detaching frangible strip 18 from hinge 16 of container 10 leaves behind upper and lower arms 36 and 38 on cover portion 12 and base portion 14, respectively. Upper and lower arms 36 and 38 extend outwardly from container 10 and can be used to facilitate removal of cover portion 12 from base portion 14, once strip 18 has been removed, by applying sufficient opposing force to disengage locking shoulder 20 from within circumferential recess 26.

The presence of bead 34 prevents unauthorized access to the contents of container 10 by making it difficult to pull cover portion 12 from base portion 14. If access to container 10 is desired, strip 18 must be removed so that upper and lower arms 36 and 38 are free to be used to leverage cover portion 12 from base portion 14. Cover portion 12 may be replaced on base portion 14 after container 10 is opened. Strip 18, however, once removed, is not replaceable. Thus, removal of strip 18 functions as a clear indicator of possible tampering, in that if strip 18 is partially or fully removed prior to purchase, it is readily apparent to a consumer that someone may have already gained access to the contents of container 10.

Figure 15:
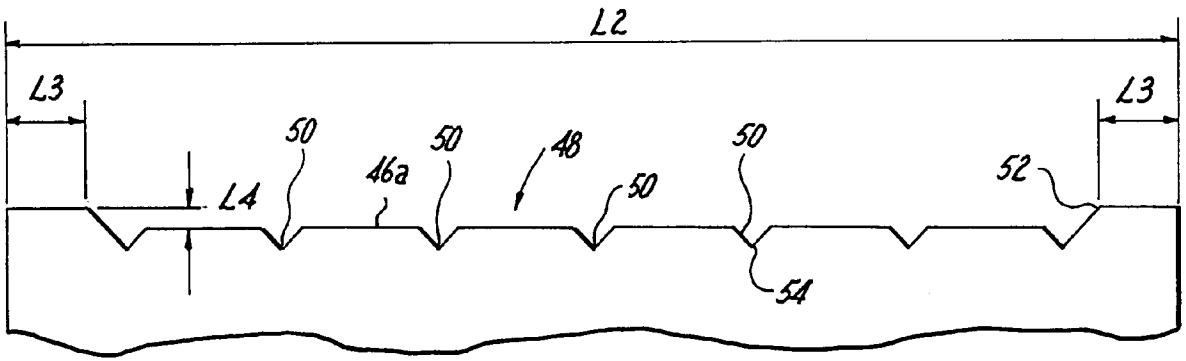
FIG. 15 is a front plan view of a second blade of the two blade knife of FIG. 13, illustrating the position of the nicks, cutting surfaces and offset that can form a second score line of a frangible section of a container constructed in accordance with the present invention.
Figure 14:
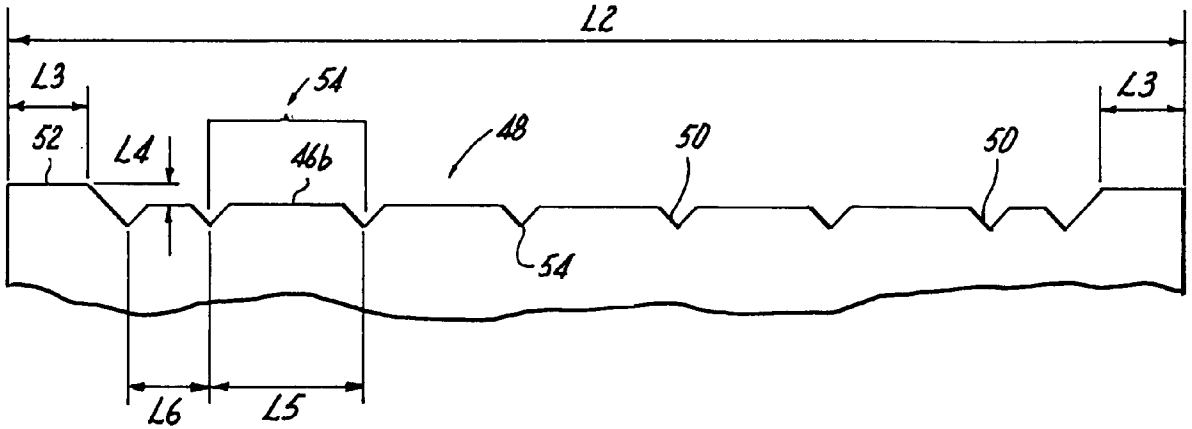
FIG. 14 is a front plan view of a first blade of the two blade knife of FIG. 13, illustrating the position of the nicks and cutting surfaces that can form a first score line of a frangible section of a container constructed in accordance with the present invention.
Figure 13:
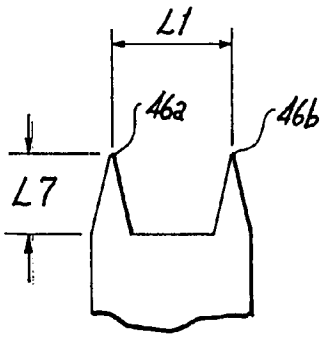
FIG. 13 is a side view of a two blade knife that can be used to form the frangible section of a container constructed in accordance with the present invention.
Figure 18:
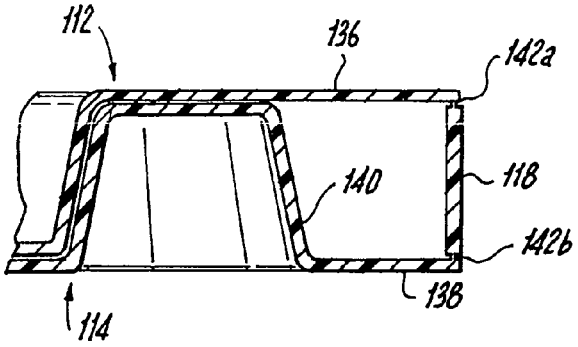
FIG. 18 is a partial cross sectional view of the container shown in FIG. 16, taken along line 18—18 of FIG. 17, illustrating in particular the configuration of the hinge, upper and lower projections and frangible section.
Figure 19:
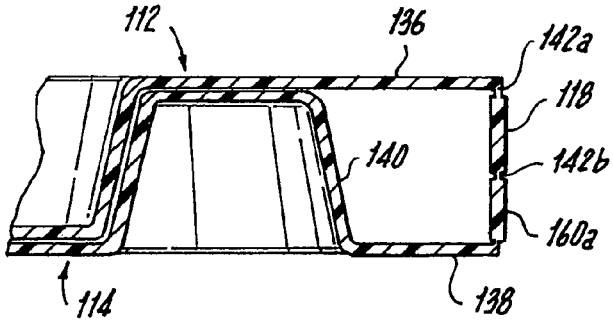
FIG. 19 is a partial cross sectional view of the container shown in FIG. 16, taken along line 19—19 of FIG. 18, illustrating in particular the configuration of the hinge, upper and lower projections, frangible section, and score line defining a tab associated with the lower projection.
Figure 20:
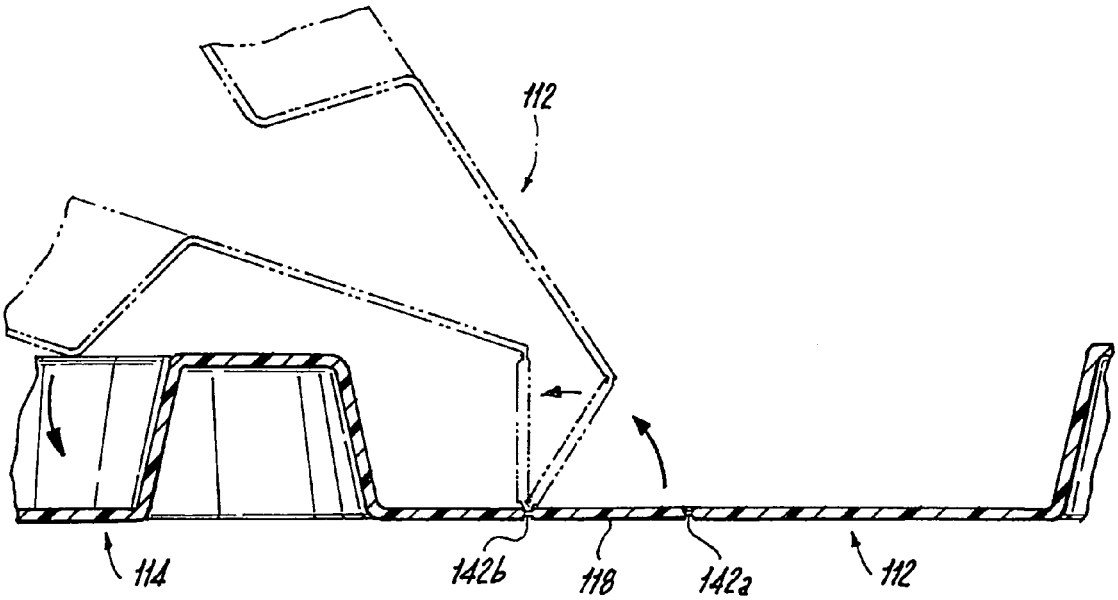
FIG. 20 is a partial cross sectional view of the container shown in FIG. 16, illustrating in particular the manner in which the cover portion is closed on the base portion.
Figure 21:
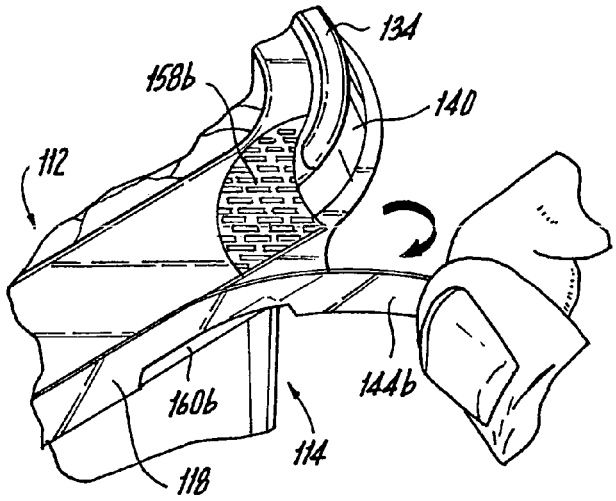
FIG. 21 is a partial perspective view of the container shown in FIG. 16, illustrating in particular the manner in which the frangible section is removed from the hinge.
Figure 22:
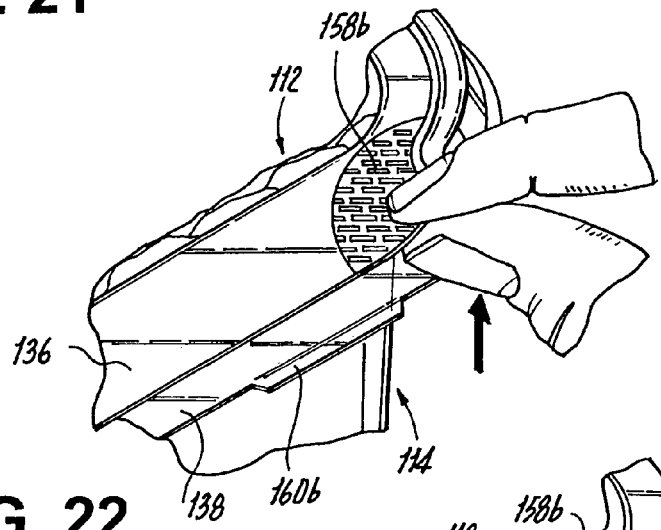
FIGS. 22–23 are partial perspective views of the container shown in FIG. 16, illustrating in particular the manner in which the separation of the cover portion from the base portion is facilitated by clasping the patterned section disposed on the upper projection or arm associated with the cover portion which is formed upon removal of the frangible section.
Figure 23:
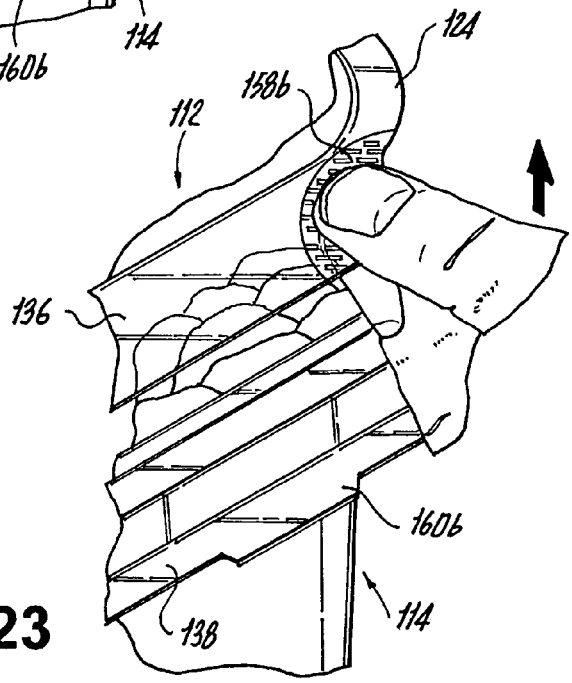

FIGS. 13–15 illustrate an exemplary configuration for a double scoring blade having blades 46*a*, 46*b*, which can be used in a punch press system or the like to form score lines 42*a*, 42*b* in accordance with the present invention. Various dimensions of blades 46*a*, 46*b* are also provided herein as a non-limiting example.

The lateral separation L1 between blades 46*a*, 46*b* is in this embodiment about 0.36 inches. The length L2 of blades 46*a*, 46*b* is about 2.25 inches. Blades 46*a*, 46*b* include an offset recessed portion 48 with a series of substantially similar nicks 50 cut therein between cutting edges 52. The width L3 of cutting edges 52 is preferably 0.36 inches. Preferably, the offset L4 between recessed portion 48 and cutting edges 52 is approximately 0.001 inches.

In this embodiment, blade 46*a* includes seven (7) nicks 50 while blade 46*b* includes eight (8) nicks 50. The nicks 50 on blade 46*a* are offset with respect to the nicks 50 on blade 46*b*, which results in a desirable zipper-like effect when removing strip 18. Preferably, nicks 50 are triangular shaped, about 0.010 inches deep and about 0.020 inches wide, and define an approximately 90 degree angle at its deepest convergence point 54. The length L5 between nicks 50, as measured between the respective convergence points 54 of adjacent nicks 50, is approximately 0.252 inches. The length L6 between the respective convergence points 54 of adjacent offset nicks 50 on blade 46*b* is about 0.126 inches. The length L7 of blades 46*a*, 46*b* is about 0.1 inches, and each blade edge defines an angle of about 45 degrees.

It should be readily understood that a container constructed in accordance with the present invention, which is preferably a plastic container used for carrying items, can be manufactured in a variety of shapes and sizes, and can be formed from resins or plastic materials such as polyethylene, polypropylene, polyvinyl chloride or polyethylene terephthalat ("PETE"), as well as other suitable materials or combinations thereof. A container constructed in accordance with the present invention can also be made partially or entirely of materials which are not plastic, such as paper or metals. For example, a container of the present invention can be fabricated of a light gauge aluminum. The forming process can also vary to include methods such as thermoforming, injection molding or blow molding. The container can be transparent or translucent, and may be colored in either instance. Also, vents can be provided in the container to promote airflow therethrough, if appropriate based on the intended contents of the container.

Preferably, container 10 is formed from a roll of PETE subjected to a vacuum and pressure mold with plug assist. During manufacture, blades 46*a*, 46*b* of FIGS. 13–15 are preferably applied to a newly formed container 10 to impart score lines 42*a*, 42*b* thereon. Cutting edges 52 cut substantially through the material used to make container 10. Preferably, the configuration of blades 46*a*, 46*b* are designed so that a desirable amount of force is necessary to remove strip 18, as determined by consumer trials for example. Those skilled in the art will readily appreciate that the configuration of blades 46*a*, 46*b* can be adjusted for a variety of reasons, and the above dimensions are exemplary of one embodiment of the present invention.

For example, various other methods can be employed to form frangible strip 18 of hinge 16. For example, score lines, nicks or penetrations can be created with the molding tool itself during the forming step. Alternatively, a high die forming process can be employed where, after the forming step, the container is indexed to a trim station, where one or more knives liberate the container and creates the score lines or perforations. Also, an intermittent cutter can be employed between the forming step or the trim step, a progressive punch and die operation can be employed, or a numerically controlled laser can be employed to create the nicks. It is also envisioned that electromechanical, ultra-sonic or hydrodynamic systems can be employed in the forming or post-forming processes.

Container 10 could also be formed with locking arrangements known in the art other than the tamper-resistant/evident closure of the subject invention, such as traditional male and female locking features.

Referring to FIGS. 16–23, there is illustrated another tamper-resistant/evident container constructed in accordance with a preferred embodiment of the subject invention and designated generally by reference numeral 110. Container 110 is similar to container 10 described above except that container 110 is rectangular in configuration rather than circular. Container 110 thus includes a base portion 114 and a cover portion 112 joined together by an integrally formed hinge 116 that defines a tamper-evident frangible pull strip 118, which must be removed before cover portion 112 can be readily removed from base portion 114.

Container 110 includes embossed or raised patterned sections 156*a* and 156*b* on opposing tabs 144*a* and 144*b* of strip 118, respectively, to facilitate removal of strip 118. Patterned sections 158*a* and 158*b* are also disposed on opposing sides of upper arm 136 to facilitate separation of cover portion 112 from base portion 114. Instructional indicia can be imprinted on upper arm 136 between patterned sections 158*a* and 158*b*.

In this embodiment, score line 142*b* is situated on hinge 116 to define two tabs 160*a* and 160*b* which are connected with lower arm 138. Tabs 160*a*, 160*b* remain in place on hinge 116 until strip 118 is removed, as can be best viewed in FIGS. 21–23. Tabs 160*a*, 160*b* extend from lower arm 138 to further facilitate gripping lower arm 138 and separation of cover portion 112 from base portion 114.

Although exemplary and preferred aspects and embodiments of the present invention and forming methods have been described with a full set of features, it is to be understood that the disclosed container and method of manufacture may be practiced successfully without the incorporation of each of those features. The scope of the present invention is not limited only to the tamper-resistant/evident containers and methods of forming and manufacture disclosed herein.

Furthermore, it should be readily apparent that the present invention is not limited to containing any one type or form of product. It is envisioned that a container constructed in accordance with the present invention can be used, or modified for use within the scope of the present invention, to hold edible or non-edible contents of varying sizes and weights.

Thus, it is to be understood that modifications and variations may be utilized without departure from the spirit and scope of the invention and method disclosed herein, as those skilled in the art will readily understand. Such modifications and variations are considered to be within the purview and scope of the appended claims and their equivalents.

What is claimed is:

1. A tamper-resistant/evident container comprising:

a) a plastic, transparent cover portion including an outwardly extending peripheral flange;

b) a base portion including an upper peripheral edge forming at least in part an upwardly projecting bead extending substantially about the perimeter of the base portion and configured to render the outwardly extending flange of the cover portion relatively inaccessible when the container is closed; and c) a tamper evident bridge connecting the cover portion to the base portion.

2. A tamper-resistant/evident container as recited in claim 1, wherein the tamper evident bridge includes a hinge joining the outwardly extending flange of the cover portion with the base portion, the hinge including a frangible section, which upon severing, provides a projection that extends out beyond the upwardly projecting bead of the upper peripheral edge of the base portion, for facilitating removal of the cover portion from the base portion to open the container.

3. A tamper-resistant/evident container as recited in claim 2, wherein a skirt depends downwardly from the upper peripheral edge of the base portion, and the hinge extends from a lower edge of the skirt to the outwardly extending flange of the cover portion.

4. A tamper-resistant/evident container as recited in claim 2, wherein the frangible section of the hinge is delimited at least in part by a pair of parallel score lines.

5. A tamper-resistant/evident container as recited in claim 4, wherein the frangible section of the hinge is further delimited by a plurality of spaced apart notches associated with the score lines.

6. A tamper-resistant/evident container as recited in claim 1, wherein the cover portion and the base portion have a generally circular configuration.

7. A tamper-resistant/evident container as recited in claim 1, wherein the cover portion and the base portion have a generally rectangular configuration.

8. A tamper-resistant/evident container as recited in claim 1, wherein at least one of the cover portion and the base portion is vented.

9. A tamper-resistant/evident container as recited in claim 1, wherein the cover portion and base portion include cooperating releasable locking structures.

10. A tamper-resistant/evident container comprising:

a) a translucent cover portion including an outwardly extending peripheral flange;

b) a base portion including an upper peripheral edge; and c) a hinge joining the outwardly extending flange of the cover portion with the base portion, the hinge including a frangible section, which upon severing, provides a projection that extends from the base portion for facilitating removal of the cover portion from the base portion to open the container.

11. A tamper-resistant/evident container as recited in claim 10, wherein the upper peripheral edge of the base portion further comprises an upwardly projecting bead extending substantially about the perimeter of the base portion configured to render the outwardly extending flange of the cover portion relatively inaccessible when the container is closed.

12. A tamper-resistant/evident container as recited in claim 10, wherein a skirt depends downwardly from the upper peripheral edge of the base portion, and the hinge extends from a lower edge of the skirt to the outwardly extending flange of the cover portion.

13. A tamper-resistant/evident container as recited in claim 10, wherein the frangible section of the hinge is delimited at least in part by a pair of parallel score lines.

14. A tamper-resistant/evident container as recited in claim 13, wherein the frangible section of the hinge is further delimited by a plurality of spaced apart notches associated with the score lines.

15. A tamper-resistant/evident container as recited in claim 10, wherein the cover portion and the base portion have a generally circular configuration.

16. A tamper-resistant/evident container as recited in claim 10, wherein the cover portion and the base portion have a generally rectangular configuration.

17. A tamper-resistant/evident container comprising:

a) a plastic transparent cover portion including an outwardly extending peripheral flange;

b) a base portion including an upper peripheral edge forming at least in part an upwardly projecting bead extending substantially about the perimeter of the base portion and configured to render the outwardly extending flange of the cover portion relatively inaccessible when the container is closed; and c) a hinge joining the outwardly extending flange of this cover portion with the base portion, the hinge including a frangible section, which upon severing, provides an arm that extends from the base portion for facilitating removal of the cover portion from the base portion to open the container.

18. A tamper-resistant/evident container as recited in claim 17, wherein a skirt depends downwardly from the upper peripheral edge of the base portion, and the hinge extends from a lower edge of the skirt to the outwardly extending flange of the cover portion.

19. A tamper-resistant/evident container as recited in claim 17, wherein the projection that extends out beyond the upwardly projecting bead of the upper peripheral edge of the base portion includes patterned sections to facilitate gripping thereof.

20. A tamper-resistant/evident container as recited in claim 17, wherein upon severing the frangible section, the projection that extends out beyond the upwardly projecting bead of the upper peripheral edge of the base portion further includes tabs for facilitating removal of the cover portion from the base portion to open the container.

21. A tamper-resistant/evident container comprising:

a) a cover portion including an outwardly extending peripheral flange;

b) a base portion including an upper peripheral edge;

c) a hinge joining the outwardly extending flange of the cover portion with the base portion, the hinge including a frangible section, which upon severing, provides a projection that extends out beyond the upwardly projecting bead of the upper peripheral edge of the base portion for facilitating removal of the cover portion from the base portion to open the container, and d) a skirt depending downwardly from the upper peripheral edge of the base portion, wherein the hinge extends from a lower edge of the skirt to the outwardly extending flange of the cover portion.

22. A tamper-resistant/evident container as recited in claim 21, wherein the frangible section of the hinge has a height substantially equal to the height of the downwardly depending skirt, and wherein the cover portion, base portion, hinge and skirt are made from a single piece of material.

23. A tamper-resistant/evident container as recited in claim 1, wherein the cover portion is colored.

24. A tamper-resistant/evident container as recited in claim 1, wherein the container is capable of being resealed in a substantially leak resistant manner after a portion of the tamper evident bridge is removed to open the container.

25. A tamper-resistant/evident container as recited in claim 1, wherein the base portion is also transparent.

26. A tamper-resistant/evident container as recited in claim 10, wherein the base portion is also translucent.

* * * * *